United States Patent [19]

Oikawa

[11] 4,164,651

[45] Aug. 14, 1979

[54] APPARATUS FOR PREVENTING INCORRECT COLLATING OF SIGNATURES

[75] Inventor: Masahiro Oikawa, Hachioji, Japan

[73] Assignee: Dai Nippon Insatsu Kabushiki Kaisha, Tokyo, Japan

[21] Appl. No.: 826,068

[22] Filed: Aug. 19, 1977

[30] Foreign Application Priority Data

Aug. 20, 1976 [JP] Japan ..... 51-110773[U]
Aug. 20, 1976 [JP] Japan ..... 51-110774[U]
Jul. 18, 1977 [JP] Japan ..... 52-85873

[51] Int. Cl.[2] ..... H01J 3/14
[52] U.S. Cl. ..... 250/216; 250/237 R
[58] Field of Search ..... 250/216, 562, 563, 568–570, 250/237 R; 356/200, 209, 71

[56] References Cited

U.S. PATENT DOCUMENTS 3,202,043 8/1965 Galey et al. ..... 356/200
3,337,717 8/1967 Cerf et al. ..... 250/566
3,338,130 8/1967 Gaffard ..... 356/200
3,456,997 7/1969 Stites et al. ..... 250/566
3,992,623 11/1976 Rhyins et al. ..... 250/216

*Primary Examiner*—David C. Nelms
*Attorney, Agent, or Firm*—Koda and Androlia

[57] ABSTRACT

An incorrect collating preventing apparatus has a photoelectrical detector including at least one optical system which comprises a lens for converting light beams from a lamp into parallel light beams, and optical means for introducing the parallel light beams through a focusing lens to a surface of each signature and for introducing substantially all of the light beams reflected by the surface of each signature to a photoelectric element, the optical means being a reflector with a hole so as to allow the reflected light beams to pass through the hole, or a transparent plate with a reflector portion where the reflected light beams are focused and are directed to the photoelectric element.

5 Claims, 22 Drawing Figures

APPARATUS FOR PREVENTING INCORRECT COLLATING OF SIGNATURES

BACKGROUND OF THE INVENTION

This invention relates to apparatuses for preventing the incorrect collating of signatures (hereinafter referred to as "incorrect collating preventing apparatuses" when applicable), and more particularly to an incorrect collating apparatus which automatically detects the incorrect collating of signatures which may be caused in gathering them by stacking one on another in the order of page numbers, and also the mixing of different grops of signatures, thereby to stop a signature gathering machine if necessary.

Heretofore, in a so-called signature gathering process for piling a plurality of signatures one on another in the order of page numbers into one book or magazine, the workers carry the signatures to a feeder box and piles them therein. For instance, in the case of one of the conventional saddle stitching machines, the signatures are loaded in the feeder box with the backs held downward, and a signature pulled out by the upper cylinder with its back held upward is opened and mounted on the gathering chain by means of the wraparound cylinder and the opening cylinder. If, in this case, some of the signatures are loaded upside down in the feeder box or unnecessary signatures are mixed in necessary signatures to be bound, it will lead to incorrect collating. Since the bookbinding operation should be carried out with great care and at high speed, the workers are liable to become fatigued as much. Accordingly, there has been a strong demand in the art for providing an apparatus which can automatically detect and prevent the incorrect collating of signatures.

Shown in FIG. 1 is a schematic diagram illustrating the aforementioned conventional saddle stitching machine to which this invention can be applied. Signatures 1 are loaded on the nose bracket 2*a* of a feeder box 2 with the backs held downward as shown in FIG. 2. These signatures loaded in the feeder box are depressed against a front plate 26 because the nose bracket 2*a* is tilted as shown in FIG. 1. The top signature 1A is sucked and retained by a vacuum sucker shifter 3, and is then clamped at its back by a clipper 4*a* provided on an upper cylinder 4. The signature thus clamped is moved in the direction of the arrow as the cylinder 4 rotates. When the back 1*a* is abutted against a printing guide 5 one wing of the signature 1 is clamped by a clipper 6*a* of a wraparound cylinder 6, while the other wing is clamped by a clipper 7*a* of an opening cylinder 7. Then, as these two cylinders 6 and 7 are rotated in the opposite directions as indicated by the arrows, the signature is allowed to leave the clamps 6*a* and 7*a*, and it is mounted over a gathering chain 9 with the aid of the pressure of air jetted by air-purge nozzles 8.

A conventional incorrect collating preventing apparatus comprises a photoelectric detector assembly which operates to photoelectrically detect marks 1*b* printed on signatures by the utilization of light reflected thereby.

The conventional photoelectric detector assembly, as shown in FIG. 3A, comprises: a light source 31 such as an ordinary electric lamp; a condenser lens 33 provided on the optical axis 32 of the light source 31, for changing light beams from the light source 31 into parallel light beams; a half mirror 35 adapted to reflect the parallel light beams in a direction of an optical axis 34 perpendicular to the optical axis 32; and a focusing lens 87 adapted to focus the light beam thus reflected into a light spot about 5mm in diameter on a surface 36 to be detected. Light beams reflected by the surface 36 are applied to a light receiving element 39 through the focusing lens 37, the half mirror 35, and a focusing lens 38 provided on the optical axis 34. When the surface 36 is moved, being irradiated by the light spot, variations in intensity of the reflected light beams are converted by the photoelectric element 39 into electrical signals which are utilized for detection.

However, this conventional photoelectric detector assembly is disadvantageous in the following points: If it is assumed that the transmission factor and reflection factor of the half mirror are respectively 50% and 50%, when the light beams from the light source are reflected toward the surface to be detected by the half mirror, the intensity thereof is reduced as much as 50%, and when the light beams reflected by the surface passes through the half mirror, the intensity thereof is reduced 50%. Accordingly, the light receiving element 39 cannot receive light satisfactorily high in intensity without increasing the intensity in brightness of the light source, which results in an increase in power consumption and a reduced service life of the assembly. Furthermore, out of the light beams reflected by the half mirror, the light beams adjacent the optical axes are further reflected by the surface of the focusing lens 37 and are applied, as stray light beams, to the photoelectric element 39. Therefore, the photoelectric element 39 is brought into so-called biased state, as a result of which the difference in intensity between the light reflected by a portion of the surface to be detected where the printed mark is provided and the light reflected by a portion of the same where no printed mark is provided, is reduced. This is undesirable from the point of view of preventing incorrect collating.

Furthermore, in the conventional incorrect collating preventing apparatus the photoelectric detector assembly has only one optical system for detection. The assembly is first set on the portions of signatures where nothing is printed, thereby to produce and store a reference signal, and then it is set on printed marks provided on the signatures thereby to produce a printed mark signal. Then, the printed mark signal is compared with the reference signal thereby to determine the signature loading conditions.

Accordingly, whenever a different group of books or magazines are bound, that is, the quality of paper is changed, or whenever, even if the quality of paper is unchanged, its color is changed, adjustment is required, which leads to a difficulty in maintenance.

In addition, as only one photoelectric element is employed in the photoelectric detector assembly, the effects of the initial drift and temperature drift os the photoelectric element cannot be disregarded. Accordingly, the apparatus cannot be used until such drifts become stabilized, which results in the waste of time. Furthermore, in the case where the distances between the photoelectric detector assembly and the sides of the signatures are caused to be non-uniform by irregularly disposing the signatures on the feeder box, or in the case where the printed marks have become deteriorated in density, erroneous operations may take place.

SUMMARY OF THE INVENTION

Accordingly, an object of this invention is to overcome the above-described difficulties accompanying conventional incorrect collating preventing apparatuses.

More specifically, an object of the invention is to provide an incorrect collating preventing apparatus in which the quantity of light of a light source is effectively utilized, and which is high in detection accuracy and long in service life.

Another object of the invention is to provide an incorrect collating preventing apparatus including a photoelectric detector assembly which is made up to two photoelectric detector section so that portions of signatures where printed marks are provided and portion of the same where no printed marks are provided can be detected at the same time.

The novel features believed characteristic of this invention are set forth in the appended claims. This invention itself, however, as well as other objects and advantages thereof will be best understood by reference to the following detailed description of illustrative embodiments when read in conjunction with the accompanying drawings, in which like parts are designated by like reference numerals or characters.

DETAILED DESCRIPTION OF THE INVENTION

Figure 3A:
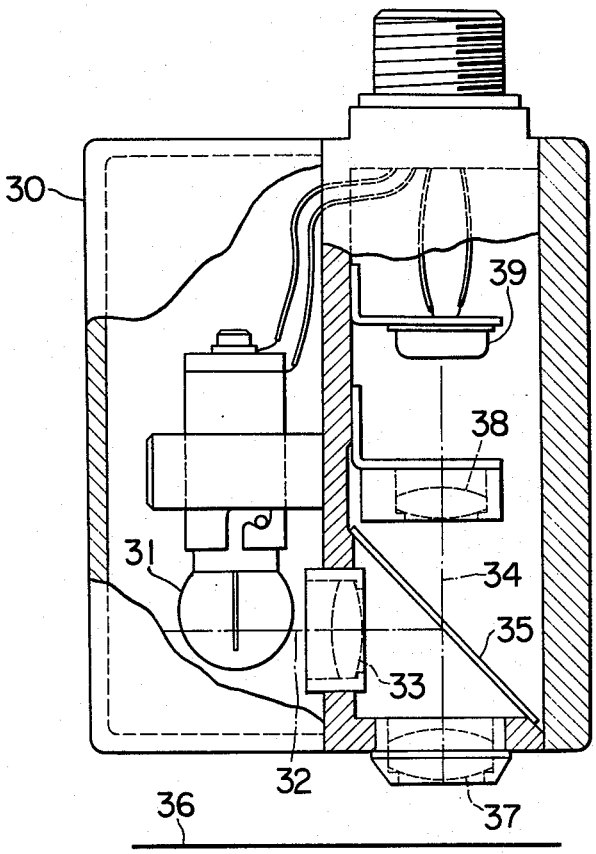
FIG. 3A is a side view, with parts cut away, illustrating a conventional photoelectric detector assembly employed in an incorrrect collating preventing apparatus.
Figure 3B:
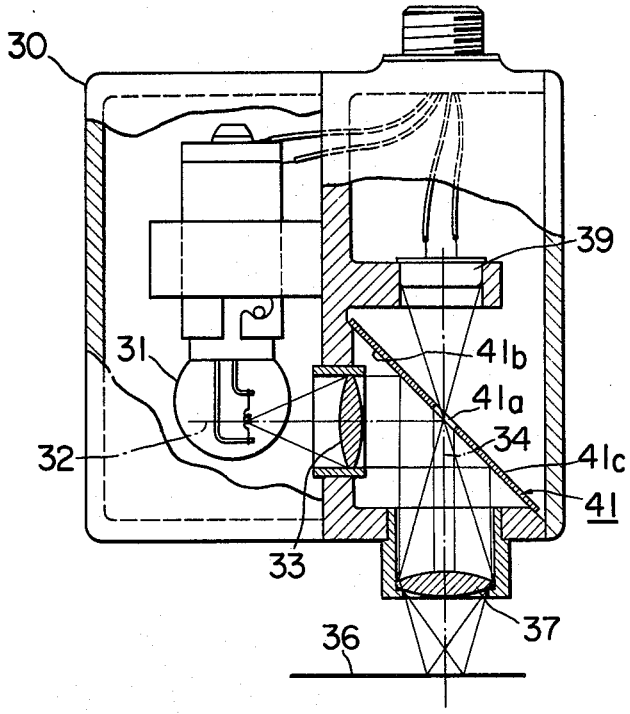
FIG. 3B is a side view, with parts cut away, illustrating a first example of a photoelectric detector assembly employed in an incorrect collating preventing apparatus.

Shown in FIG. 3B is a first example of the photoelectric detector assembly in an incorrect collating preventing apparatus according to this invention.

As is apparent from comparison between FIGS. 3A and 3B, the photoelectric detector assembly shown in FIG. 3B is, in general, similar to but different from that shown in FIG. 3A only in that the focusing lens 38 is eliminated, and a reflector 41 having a through hole **41*a* is provided in place of the half mirror (FIG. 3A) in such a manner that light beams from the light source 31 are reflected toward a surface 36 to be detected (hereinafter referred to as "a detection surface" when applicable). Therefore, the descriptions of like parts can be applied, as they are, to those in FIG. 3B**.

Figure 5A:
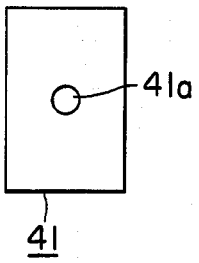
FIGS. 5A and 5B are respectively a plan view and a sectional view showing a reflector employed in the first and third examples of the photoelectric detector assembly.
Figure 5B:
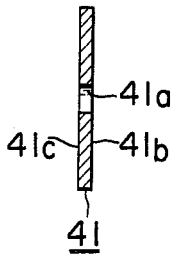

The reflector 41, as shown in FIGS. 5A and 5B, is made of a glass, plastic, or metal plate and is provide with the hole **41*a* at the central portion. The hole 41*a* may be circular, elliptical, or polygonal. A layer of aluminum for reflecting light is deposited by vacuum evaporation on one 41*b* of the two surfaces of the reflector 41. This surface 41*b* is faced toward the light source 31. The other surface 41*c* is coated with black non-reflection paint, and is faced toward the photoelectric element 39**.

The area of the hole **41*a* can be 50% of the area of the reflector 41 irradiated by the light source 31 in order to obtain the same quantity of reflection light as that in the case of the half mirror described before. However, it should be noted that the reflection light from the detection surface 36 is received 100% by the photoelectric element 39, passing through the hole 41*a* instead of the half mirror having a low transmission factor. Therefore, the area of the hole 41*a* should be about 10–50% of the reflector area irradiated by the parallel light beams from the light source 31 so that the detection surface 36** is irradiated thereby as much as possible.

The position of the hole **41*a* is so determined that the reflection light from the detection surface 36 is focused in the vicinity of the hole 41*a* after passing through the focusing lens 37. As a result, the reflection light from the detection surface 36 is most effectively received by the photoelectric element 39. Since in the vicinity of the optical axis 34 the light beams from the light source are not reflected toward the focusing lens because of the presence of the hole 41*a*, there are no light beams reflected the light beams from the light source 31 are not reflected toward the focusing lens 37, in the vicinity of the optical axis, light beams reflected toward the photoelectric element toward the photoelectric element 39 by the focusing lens 37, and accordingly the photoelectric element 39 is not biased, which leads to an improvement of the detection sensitivity or accuracy. Accordingly, the radius of curvature of the focusing lens 37** can be increased, which facilitates the manufacture of the lens.

If summarized, in the first example of the photoelectric detector assembly, the light beams from the light source 31 are changed into the parallel light beams by means of the condenser lens 33, and the parallel light beams thus obtained are reflected toward the detection surface 36 by the reflecting surface 41*b* of the reflector 41. Then, the parallel light beams are focused into a light spot about 3mm–10 mm in diameter on the detection surface 36. The reflection light beams from the detection surface 36 are focused in the hole 41*a* of the reflector 41 by means of the focusing lens 37, and therefore all of the reflection light beams are allowed to pass through the hole 41*a* so as to be received by the photoelectric element 39. Thus, the difference in reflection light intensity between one portion of the detection surface where the printed mark is provided and another portion of the same where no printed mark is provided can be positively detected, and this difference is converted into an electrical signal for detection.

In addition, the photoelectric element 39 will never suffer from light beams reflected directly by the focusing lens 37, and therefore the photoelectric element 39 is not biased, which leads to the improvement of the detection accuracy as was described. Furthermore, no half mirror is employed, and therefore there is no loss in the quantity of light, and the voltage of the light source 31 can be lower, which leads to reduction of the power consumption and an improvement of the service life of the photoelectric detector assembly.

If summarized, the light beams from the light source are effectively introduced to the detection surface by means of the reflector, and the light beams reflected by the detection surface are also effectively received by the photoelectric element through the hole provided in the reflector. As the hole does not reflect the light beams from the light source, there are no incident light beams to the focusing lens in the vicinity of the optical axis thereof. Therefore, stray light beams produced and introduce to the photoelectric element when such incident light beams are reflected by the surface of the focusing lens, can be eliminated according to the invention. Accordingly, as was described before, biasing the photoelectric element can be eliminated, which leads to the improvement of detection accuracy.

The first example has been described with reference to the case where it is employed as a mark detector. However, if a suitable photoelectric element is employed, the photoelectric detector assembly may be used as a detector for detecting the intensity of color, or as a line follower detector which can be controlled in response to lines printed in the edge of a web.

Figure 3C:
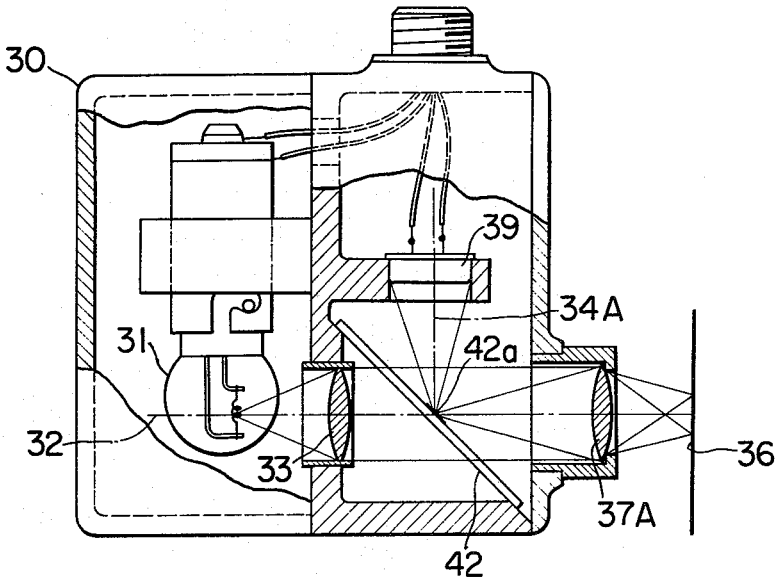
FIG. 3C is also a side view, with parts cut away, illustrating a second example of the photoelectric detector assembly.

Shown in FIG. 3C is a second example of the photoelectric detector assembly in the incorrect collating preventing apparatus according to this invention.

As is seen from comparison between FIGS. 3B and 3C, the second example is different from the first example shown in FIG. 3B only in that a transparent plate 42 is employed instead of the reflector 41, and a focusing lens 37A and a detection surface 36 are on the optical axis 32. Therefore, the descriptions of like parts are applied, as they are, to those in the second example.

The light beams from a light source 31 are changed into parallel light beams by means of a condenser lens 33, and the parallel light beams thus obtained are focused into a light spot on the detection surface 36 through the focusing lens 37A.

Figure 10A:
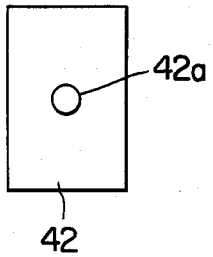
FIGS. 10A and 10B are respectively a plan view and a sectional view of a transparent plate with a reflector portion employed in the second and fourth examples of the photoelectric detector assembly.
Figure 10B:
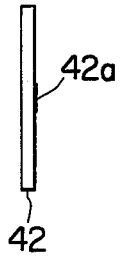

According to a feature of the second example, the aforementioned transparent plate 42 is provided obliquely between the condenser lens 33 and the focusing lens 37A. As shown in FIGS. 10A and 10B, a circular, elliptical or polygonal reflector portion 42*a* whose center coincides with the optical axis 32 is provided on one surface of the transparent plate 42 which faces the detection surface 36 through the focusing lens 37A. More specifically, the position of this reflector portion 42*a* is so determined that it is at a point on the optical axis 32 where light beams reflected by the detection surface are focused by means of the focusing lens 37A. Accordingly, the light beams from the detection surface 36 are focused on the reflector portion 42*a* of the transparent plate 42, and are reflected by the reflector portion 42*a* toward the photoelectric element 39 provided on an optical axis 34A forming an angle with the optical axis 32. As a result, the reflected light beams are received by the photoelectric element 39, and as the detection surface 36 is moved, the difference in reflection light intensity between a first portion of the detection surface 36 where the printed mark is provided and a second portion of the detection surface where no printed mark is provided, are detected similarly as in the first example.

The transparent plate 42 itself is made of transparent glass or plastic material, and the reflector portion 42*a* is obtained by vacuum-evaporation of aluminum.

As is apparent from the above description, in the second example also, the detection surface 36 is effectively irradiated with the light beams from the light source by means of the transparent plate 42 because the transparent plate, unlike the half mirror, has no loss in light transmission. Furthermore, since the light beams reflected by the detection surface 36 are focused on the reflector portion 42*a* by means of the focusing lens 37A, these light beams are received 100% by the photoelectric element 39. Thus, it can be said that the efficiency of the photoelectric detector assembly is very high. Furthermore, some, adjacent the optical axis 32, of the parallel light beams are blocked by the reflector portion 42*a*; that is, they cannot reach the focusing lens 37A. Therefore, similarily as in the first example, there is no light beam that is reflected by the surface of the focusing lens 37A toward the photoelectric element 39, and accordingly, the photoelectric element 39 is not biased, which leads to an improvement of the detection accuracy.

In the second example (FIG. 3C) also, the light beams reflected by the detection surface 36 are delivered 100% to the photoelectric element 39 as was described above, the area of the reflector portion 42*a* can be about 10–50% of the transparent plate area directly irradiated by the parallel light beams obtained by the condenser lens 33. In addition, when compared with that in the conventional photoelectric detector (FIG. 3A) the quantity of light irradiating the detection surface 36 is increased, and therefore the intensity of the light source can be decreased to obtain the predetermined quantity of light irradiating the detection surface.

Furthermore, similarly as in the first example (FIG. 3B), if a suitable photoelectric element is employed, the photoelectric detector may be used as a detector for detecting the intensity of color, or as a line follower detector which can be controlled in response to lines printed in the edge of a web.

If summarized, in the second example also, the light beams from the light source can be effectively applied to the detection surface. Therefore, the intensity of the light source and accordingly the power consumption can be decreased, while the service life of the photoelectric detector assembly can be lengthened. The light beams reflected by the detection surface are focused on the reflector portion of the transparent plate by the focusing lens, and are effectively received by the photoelectric elements. As some of the parallel light beams in the vicinity of the optical axis are blocked by the reflector portion, the occurrence of the stray light beams which may affect the detection accuracy can be eliminated.

In the above-described two examples, the photoelectric detector assembly has only one optical system. However, in third and fourth examples which will be described hereinafter, according to another aspect of this invention, the photoelectric detector assembly is improved to have two optical systems with a common light source.

Figure 1:
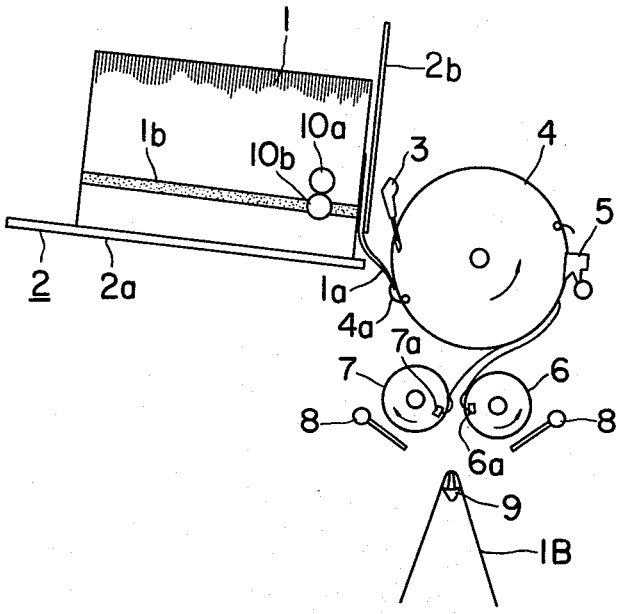
FIG. 1 is an explanatory diagram briefly illustrating the arrangement of a saddle stitching machine to which this invention can be applied.
Figure 2:
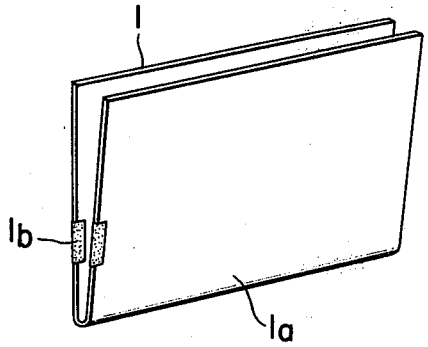
FIG. 2 is a perspective view of a signature.

Referring back to FIGS. 1 and 2, printed marks 1*b* having a predetermined length are provided on the lower margin portions of signatures 1, and the two optical systems, or a pair of photoelectric detector sections 10*a* and 10*b* forming the photoelectric detector assembly are provided beside the feeder box 2. One group of signatures 1 to be loaded in one and the same feeder box have the printed marks 16 which are equally spaced from the backs 1*a* of the signatures 1. However, the printed marks 1*a* of signatures of different groups are differently spaced from the backs 1*a*. One of the photoelectric detector sections, for instance the photoelectric detector section 10*b* is placed so as to confront a line of printed marks 1*b*. As the signatures 1 slide along the nose bracket 2*a*, the photoelectric detector section 10*b* successively detects the printed marks 1*b* to provide printed mark signals, while the other photoelectric detector section 10*a* detects the portions of the signatures where no printed marks are provided, thereby to provide reference signals. These signals are subjected to comparison so as to determine whether the signatures are suitably loaded in the feeder box or not.

Figure 4A:
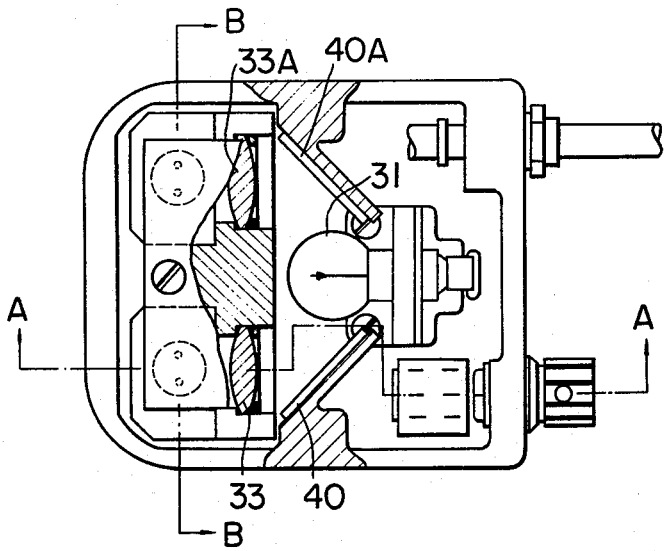
FIGS. 4A, 4B and 4C are various views, with part cut away, showing a third example of the photoelectric detector assembly.
Figure 4B:
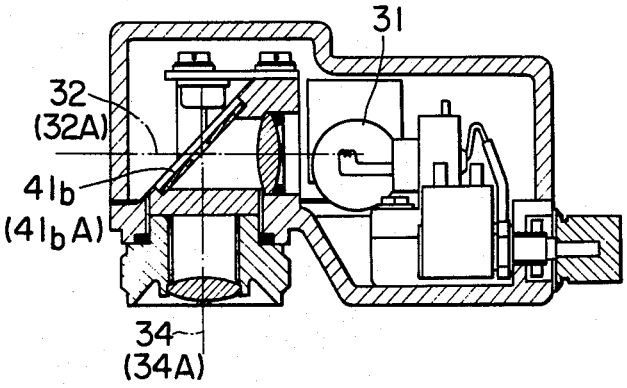
Figure 4C:
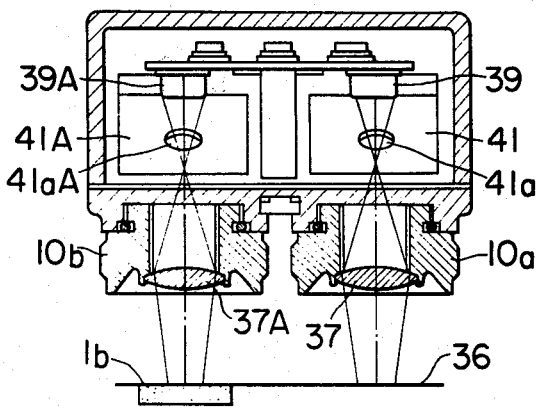

One embodiment of the technical concept described above will be described as a third example of the invention with reference to FIGS. 4A, 4B, and 4C.

In this example, instead of the half mirror 35 (FIG. 3A) are provided reflectors 41 and 41A having respective holes 41*a* and 41*a*A for reflecting light beams emitted by a light source 31 toward a detection surface 36. Each of the reflectors 41 and 41A is identical to that shown in FIGS. 5A and 5B. In other words, the reflector 41 (41A) has at the central portion the hole 41*a* (41*a*A) which is circular, elliptical, or polygonal. One of the two surfaces of the reflector 41 (41A) has a reflecting layer of aluminum obtained by vacuum evaporation which faces the light source 31, while the other surface is coated with black non-reflection paint 41*c* (41*c*A) and faces a photoelectric element 39 (39A).

In this case also, due to the same reason as in the first example (FIG. 5B), the area of the hole 41*a* (41*a*A) should be of the order of 10–50 of the reflector area irradiated by the light beams from the light source 31 so that the detection surface 36 is irradiated thereby as much as possible.

Similarly as in the first example (FIG. 5B) the hole 41*a* (41A) of the reflector 41(41A) is so positioned that the light beams reflected by the detection surface 36 are focused in the vicinity of the hole 41*a* (41*a*A) by means of a focusing lens 37 (37A). Therefore, the reflection light beams from the detection surface 36 are effectively received by the photoelectric element 39 (39A), and in the vicinity of an optical axis 34 (34A) the light beams from the light source 31 are not reflected toward the focusing lens 37(37A) because of the provision of the hole 41*a* (41*a*A); that is, there is no light beam which is reflected by the surface of the focusing lens 37(37A) toward the photoelectric element 39(39A). Accordingly, in this example also, the photoelectric element is never be biased by the stray light beams, which lead to an improvement of the detection accuracy. Accordingly, similarly as in the first example, the radius of curvature of the focusing lens 37 (37A) can be increased, and its manufacture can be readily achieved.

In the photoelectric detector assembly thus organized, the light beams emitted from the light source 31 are formed into two pencils of parallel light beams through mirrors 40 and 40A and the condensor lenses 33 and 33A, respectively. The two pencils of parallel light beams are reflected toward the detection surface 36 by the reflecting aluminum layers 41*b* and 41*b*A of the reflectors 41 and 41A and are focused into light spots 3–10 mm in diameter on the detection surface 36, respectively. Two pencils of light beams reflected by the detection surface 36 are focused in the vicinities of the holes 41*a* and 41*a*A and are therefore received 100% by the photoelectric elements 39 and 39A, respectively, so that the portion having the printed mark and the portion having no printed mark of the detection surface are detected at the same time; that is, the intensities of the reflection lights from the two portions are simultaneously detected and converted into respective electrical signals, and the difference between the electrical signals thus obtained is detected. Similarly as in the first example (FIG. 3B) the light beams directly reflected by the lenses 37 and 37A are eliminated, and therefore the photoelectric elements 39 and 39A are not biased by the stray light beams, which leads to an improvement of the detection accuracy.

In the third example, as the half mirror is not employed, there is no loss in light quantity. Therefore, it is possible to reduce the voltage of the light source 31; that is, it possible to reduce the power consumption and to lengthen the service life of the assembly when compared with those in the conventional photoelectric detector assembly. Furthermore, only one light source 31 is employed for irradiation of both the portion having the printed mark and the portion having no printed mark of the detection surface, and therefore variation with time in brightness of the lamp is automatically corrected.

Figure 6A:
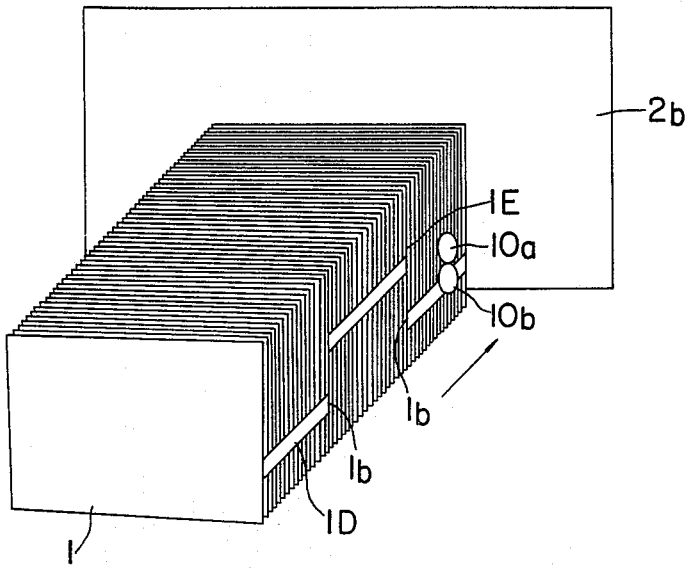
FIGS. 6A and 6B are explanatory diagrams for a description of the detection of signatures which have been incorrectly collated.
Figure 6B:
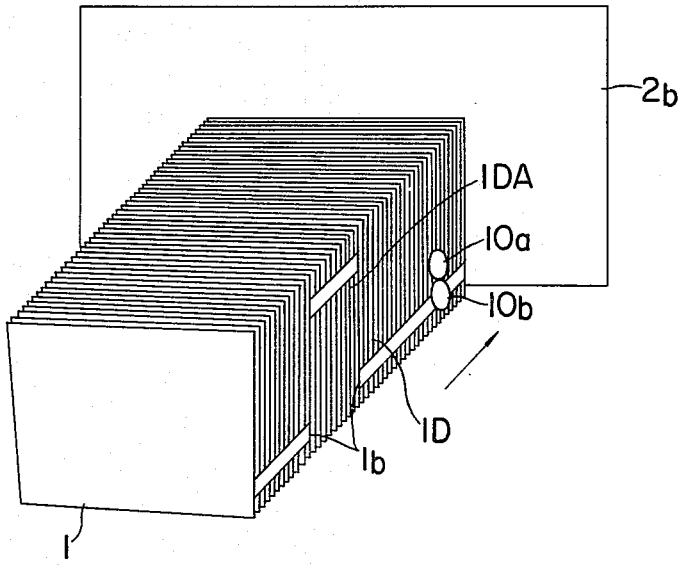

Incidentally, FIGS. 6(A) and 6(B) illustrate two cases where signatures incorrectly collated are under detection. In the first case (FIG. 6A), a group of unnecessary signatures 1E is mixed in a group of necessary signatures 1D, in a feeder box. In this case, the photoelectric detector section 10*b* adapted to detect the printed marks of the neccessary signatures 1D cannot detect the printed marks of the unnecessary signatures 1E. On the other hand, in the second case FIG. 6B, some 1DA of the necessary signatures 1D are set upside down in the feeder box. In this case also, the photoelectric detector section 10*b* cannot detect the printed marks of the signatures 1D. Therefore, in either of the two cases a signal indicating such an abnormal state of signatures is generated to stop the saddle stitching machine.

Figure 7:
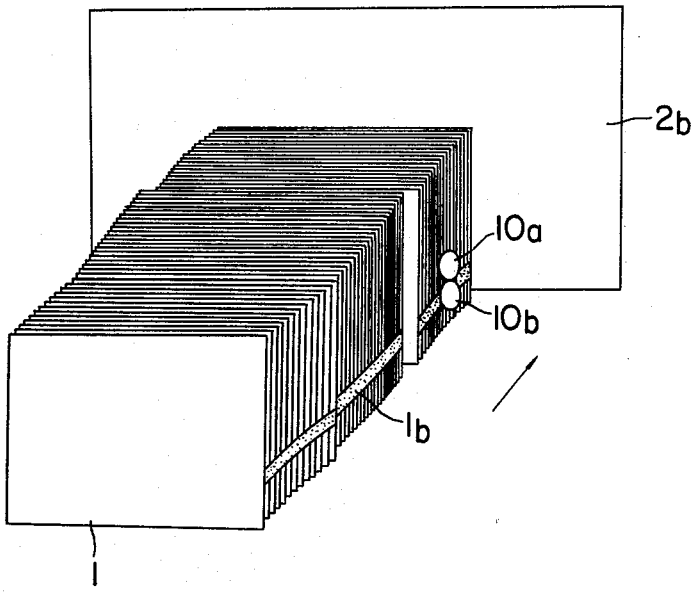
FIG. 7 is also on explanatory diagram for a description of the detection of signatures whose lower margin portions are irregularly arranged on a feeder box.

FIG. 7 shows a case where signatures are not regularly aligned with respect to the lower margin portions thereof which are faced toward the photoelectric detector assembly 10. In this case, since the photoelectric detector assembly 10 has a pair of photoelectric detector sections 10*a* and 10*b* in the third example according to this invention, the reference detection signal and the printed mark detection signal produced thereby change at the same rate, and therefore no detection error or erroneous operation is caused.

In the case where a photoelectric detector assembly having a single photoelectric detector section is used to detect printed marks to prevent incorrect collating, the detecting operation becomes unstable due to the variations in density of the printed marks, and the erroneous operation is liable to be caused by the variation in brightness of the light source, and furthermore it is difficult to set the operating level of the photoelectric detector.

However, these difficulties can be positively overcome by the provision of the third example in which the photoelectric detector assembly has two optical systems, or two photoelectric detector sections, according to the invention. Furthermore, by the provision of the two photoelectric detector sections, the printed marks can be positively detected irrespective of the variations in background color of the signatures when compared with a photoelectric detector assembly having a single photoelectric detector section.

The present invention has been described with reference to the case where the photoelectric detector assembly is employed in a saddle stitching machine; however, it can be applied to other stitching machines also. In the above description, the printed marks are provided in the lower margin portions of signatures; however, it should be noted that the marks can be provided in other portions thereof.

Figure 8:
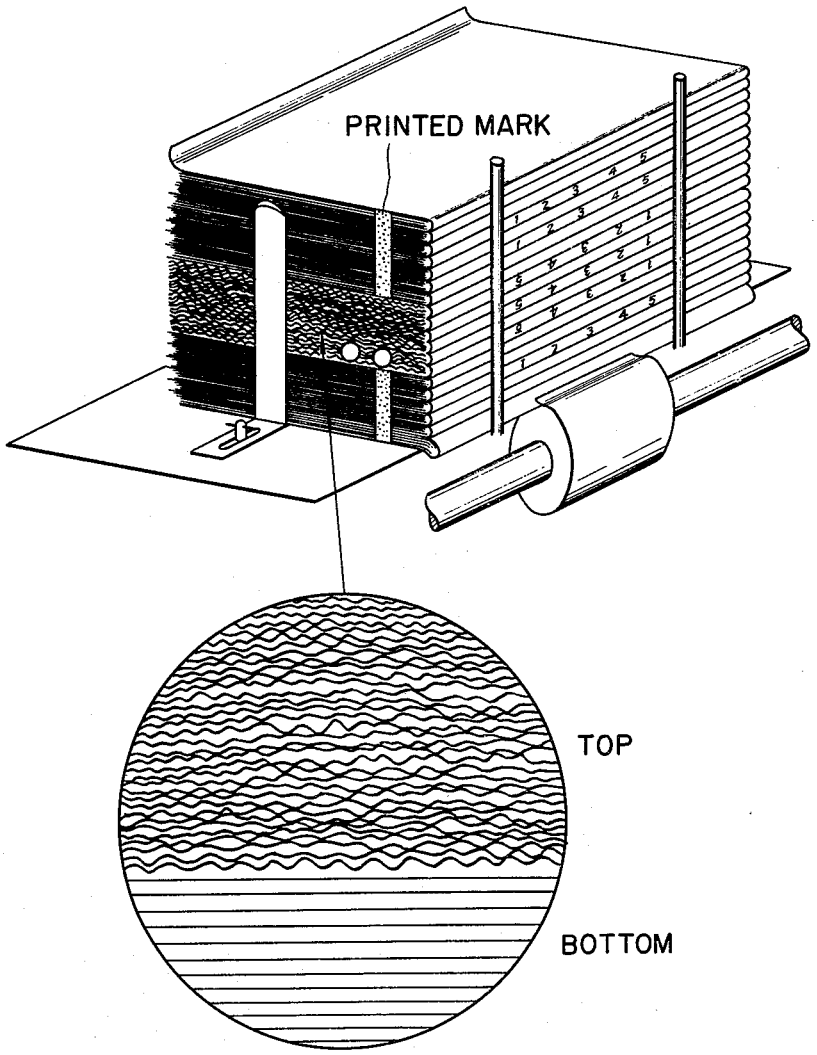
FIG. 8 is a perspective view showing signatures which are incorrectly loaded on a saddle stitching machine.

A signature has a top edge cut rough and a bottom edge obtained by folding a sheet. Therefore, if in a side stitching machine some of the signatures are set upside down as shown in FIG. 8, the reflection factor of the top edge is markedly lower than that of the bottom edge, and therefore a signal obtained by detecting the top edge is substantially equal in level to the printed mark signal. Accordingly it is impossible for a photoelectric detector assembly with a single photoelectric detector section to prevent such incorrect collating. However, as the third example according to the invention has two photoelectric detector sections, this incorrect collating can be positively detected. In other words, the output of the reference signal detector becomes equal to that of the printed mark detector when detecting said signatures set upside down (this detection being the same as that in FIG. 6A), as a result of which the signal indicating an abnormal condition of the signatures is produced to stop the side stitching machine.

Figure 9A:
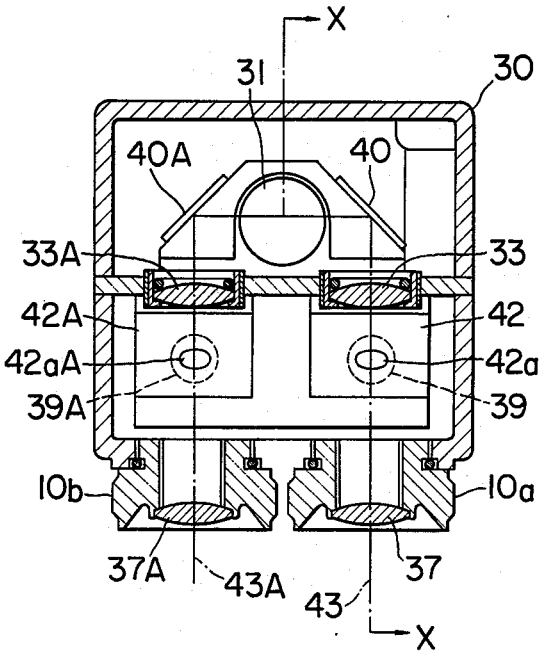
FIGS. 9A and 9B are sectional views illustrating a structure of a fourth example of the photoelectric detector assembly.
Figure 9B:
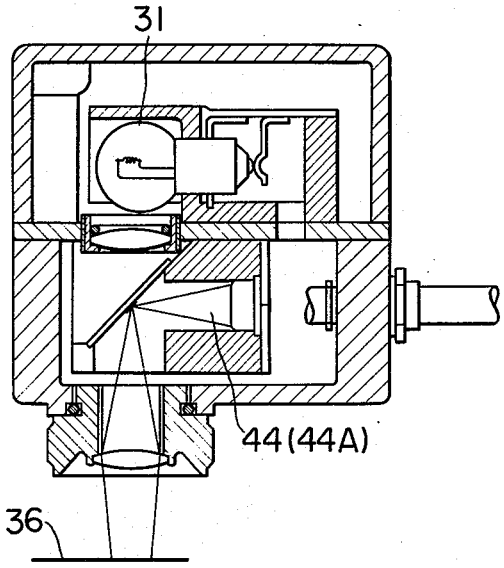

Shown in FIGS. 9A and 9B is a fourth example of the photoelectric detector assembly according to the invention which has been developed from the second example. Light beams from a light source 31 in a housing 30 are refracted by mirrors 40 and 40A and are changed into two pencils of parallel light beams by condenser lenses 33 and 33A, respectively. The two pencils of parallel light beams are focused into light spots on a detection surface 36 by focusing lenses 37 and 37A, respectively. Transparent plates 42 and 42A are provided between the condenser lens 33 and the focusing lens 37 and between the condenser lens 33A and the focusing lens 37A, respectively. Similarly as in the second example, the transparent plate 42 (42A) has a reflector portion 42*a* (42*a*A) on its one surface which is faced toward the detection surface 36. The reflector 42*a* (42*a*A) is circular, elliptical or polygonal, and its center coincides with an optical axis 43 (43*a*). More specifically, the reflector portion 42*a* (42*a*A) is positioned at a point on the optical axis 43 (43A) where the light beams reflected by the detection surface 36 is focused by means of the focusing lens 37 (37A), similarly as in the second example. Therefore, the reflection light beams from the detection surface 36 is focused on the reflector portion 42*a* (42*a*A), and is reflected along an optical axis 44 (44*a*) forming a predetermined angle with the axis 43 (43A) toward the photoelectric element 39 (39A). Thus, the portion of the detection surface where the printed mark is provided and the portion of the same where no printed mark is provided are detected at the same time and are converted into electrical signals. The difference between these electrical signals is utilized for prevention of incorrect collating.

Each of the transparent plates 42 and 42A is identical with that employed in the second example.

Therefore, the functions, effects, and merits of the fourth example with respect to each optical system therein are similar to those of the second example (FIG. 3C). However, it should be noted that owing to the provision of two optical systems 10*a* and 10*b* the fourth example can detect two portions of the detection surface 36 at the same time, the former having a printed mark, the latter having no printed marks.

Figure 11:
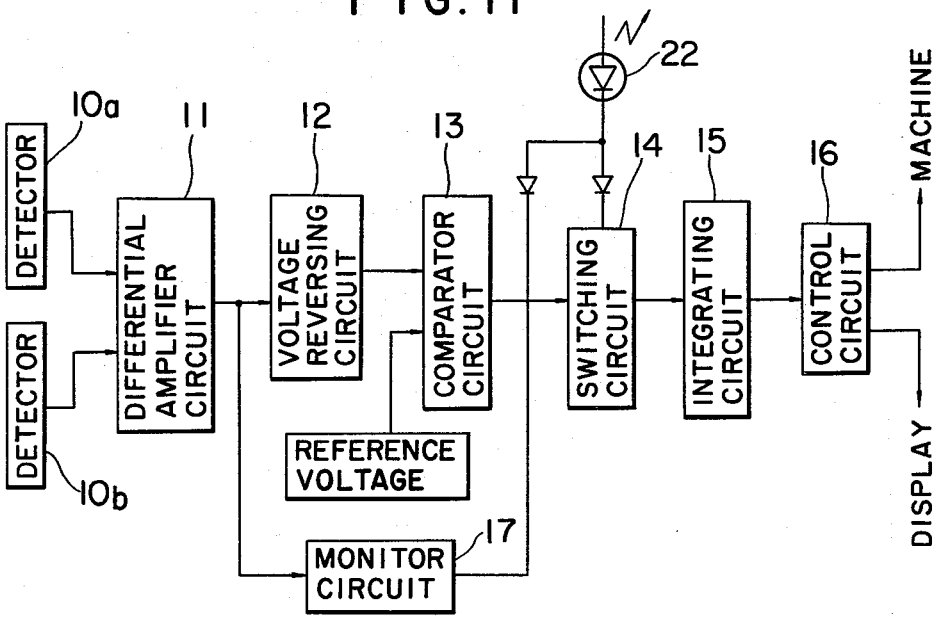
FIG. 11 is a block diagram showing an incorrect collating preventing apparatus employing the third or fourth example of the photoelectric detector assembly.

Shown in FIG. 11 is a block diagram of the incorrect collating preventing apparatus. The reference signal and the printed mark signal produced respectively by the photoelectric detector sections 10*a* and 10*b* are subjected to comparison and amplification in a differential amplifier circuit 11 which, when only the printed mark signal is detected, produces an output. This output is applied to a voltage reversing circuit 12 and a monitor circuit 17.

The voltage inverting circuit 12 serves as an interface unit for a comparator circuit 13. More specifically, in the case where the printed marks are provided at parts, above the lower margin portions, of the signatures, it is impossible for the photoelectric detector section 10*a* to produce the reference signal. Therefore, in this case, the photoelectric detector sections 10*b* and 10*a* serve to detect the reference signal and the printed mark signal, respectively. Accordingly, the output of the differential amplifier circuit 11 is negative. This negative output is changed into a positive output by the voltage reversing circuit 12.

The monitor circuit 17 is to monitor the photoelectric detector assembly mounting conditions, and the operating conditions thereof.

The output of the voltage reversing circuit 12 is applied to the comparator circuit 13, where it is compared with a predetermined reference voltage, so that noise representative of uneveness of the signatures set in the feeder box is removed, and only when the printed mark signal is detected, the comparator circuit 13 produces a positive output. The output of the comparator circuit is applied to a switching circuit 14. When the printed mark signal is detected, the switching circuit 14 is turned on, and an integrating circuit 15 is turned off. In contrast, when no printed mark signal is detected, the switching circuit 14 is turned off, while the integrating circuit 15 is turned on. As a result, a control circuit 16 is rendered operable so that an alarm display unit is operated and part of or all of the operations of the above-described saddle stitching machine is suspended by relay means. In addition, if the integration time of the integrating circuit is set to a suitable value, it is possible to render the control circuit 16 inoperable in the case also where no printed mark cannot be detected because the folding of signatures is incorrect.

Figure 12:
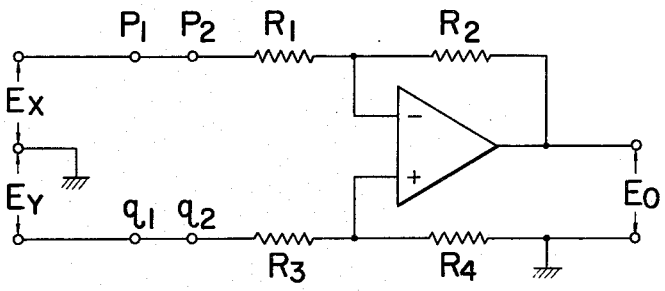
FIGS. 12 and 13 are electrical circuit diagrams showing a differential amplifier circuit included in the incorrect collating preventing apparatus shown in FIG. 11.

FIG. 12 shows one example of the differential amplifier circuit 11. In the case where the light receiving element of the photoelectric detector assembly is of the CdS type, the reflection factor of the reference surface (where no printed mark is provided) is higher than that of the printed mark 1*b*. Therefore, if the reference signal output and the printed mark signal output are represented by Ex and Ey, respectively, then $Ex<Ey$. If it is assumed that $R_1=R_3$, $R_2=R_4$, and $R_1<R_2$, then the output $E_o$ of the differential amplifier circuit is equal to $(Ey-Ex)\cdot(R_2/R_1)$, and $E_o>>0$ (V).

When the photoelectric detector 10*b* does not confront the printed mark 1*b*, $Ex\approx Ey$, and $E_o\approx 0$ (V).

In the case where, as was described before, the printed marks 1*b* of the signatures are displaced higher than their regular positions and therefore it is impossible for the photoelectric detector section 10*a* to detect the reference signal, in contrast to the ordinary arrangement, the photoelectric detector sections 10*a* and 10*b* serve to detect the printed mark signal and the reference signal, respectively. In this case, the printed mark signal output and the reference signal output are represented by Ex and Ey, respectively. Therefore, $Ex>Ey$, and $E_o<<0$ (V) because of $E_o=(Ey-Ex)\,R_2/R_1$. Thus, the polarity of the output of the differential amplifier circuit is reversed.

Figure 13:
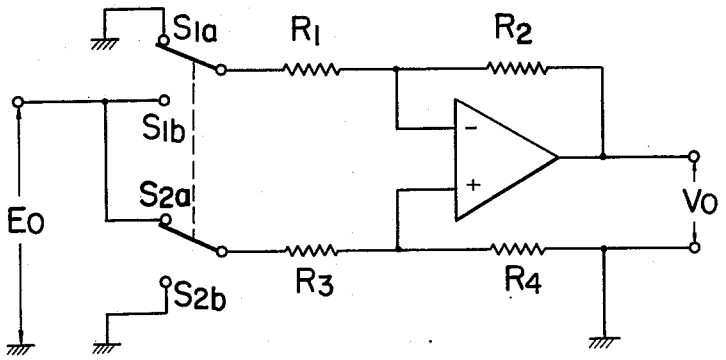

FIG. 13 is a schematic circuit diagram showing the voltage reversing circuit 13 which operates to restore the reversed polarity of the output of the differential amplifier circuit. With $E_o>>0$ (V), the circuit (FIG. 13) becomes a non-reversal circuit by positioning the armatures of a switch S as shown in FIG. 13 (or connecting the armatures to contacts $S_{1a}$ and $S_{2a}$). In this case, the output $V_o$ of the voltage reversing circuit is $$V_o = E_o\frac{R_4}{R_3+R_4}\cdot\frac{R_1+R_2}{R_1} \qquad R_1=R_2=R_3=R_4.$$

Therefore, the output $V_o$ is equal to $E_o$ ($V_o=E_o$) and is a non-reversal output.

In contrast, with $E_o<<0$ (V), the circuit (FIG. 13) becomes a reversal circuit by connecting the armatures of the switch S respectively to the contacts $S_{1b}$ and $S_{2b}$. In this case, the output $V_o$ of the voltage reversing circuit is $$V_o=-E_o\cdot R_2/R_1.$$

Therefore, the reversed output $-E_o=V_o$ can be obtained.

Since, when the photoelectric detector section 10*b* confronts the printed mark 1*b*, the output $E_o$ of the differential amplifier circuit is much greater than 0 volt ($E_o>>0$ (V)), the output $V_o$ of the voltage reversing circuit becomes much greater than 0 volt ($V_o>>0$ (V)) by connecting the armatures of the switch S respectively to the contacts $S_{1a}$ and $S_{2a}$. When the photoelectric detector section 10*b* detects no printed mark 1*b*, the output $E_o$ of the differential amplifier circuit is approximately 0 volts ($E_o\approx 0$ (V)), and the output $V_o$ of the voltage reversing circuit is also approximately 0 volt ($V_o\approx 0$ (V)).

In contrast, when the photoelectric detector section 10*a* confronts the printed mark 1*b*, the output $E_o$ of the differential amplifier circuit becomes much less than 0 volt ($E_o<<0$ (V)), and therefore by connecting the armatures of the switch S respectively the contacts $S_{1b}$ and $S_{2b}$ the output $V_o$ of the voltage reversing circuit becomes much greater than 0 volt ($V_o>>0$ (V)). When the photoelectric detector section detects no printed mark 1*b*, the output $E_o$ of the differential amplifier section is approximately 0 volt ($E_o\approx 0$ (V)), and the output $V_o$ of the voltage reversing circuit is also approximately 0 volt ($V_o\approx 0$ (V)).

Thus, if the armatures of the switch S are selectively tripped, any one of the photoelectric detector sections 10*a* and 10*b* can be used for producing either the reference signal or the printed mark signal. If required, the above-described polarity reversing operation can be obtained by connecting the circuit points $p_1$ and $q_1$ respectively to the circuit points $q_2$ and $p_2$ by means of a switch.

Figure 14:
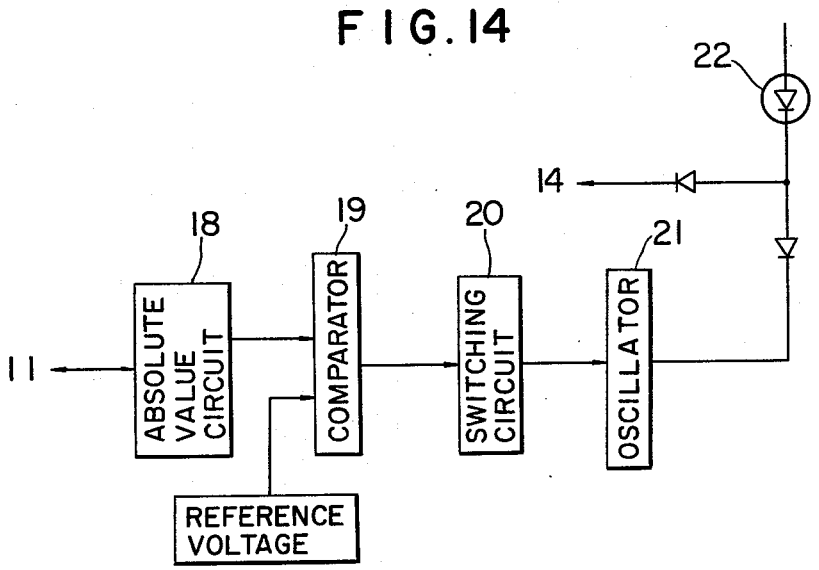
FIG. 14 is a block diagram showing a monitor circuit included in the incorrect collating preventing apparatus shown in FIG. 11.

FIG. 14 shows an arrangement of the monitor circuit 17 which makes displays as to whether or not the mounting of the photoelectric detector assembly is satisfactory.

After installation of the photoelectric detector assembly, the photoelectric detector sections 10*a* and 10*b* are moved toward the reference surface where no printed marks are provided, if in this case, the mounting of the assembly is correct, the output $E_o$ of the differential amplifier circuit 11 becomes approximately 0 volt ($E_o\approx 0$ (V)). If the mounting of the assembly is incorrect (if the assembly is not in parallel with the signatures loaded on the feeder box, for instance), $E_o>0$(V) or $E_o<0$(V), which is applied to an absolute value circuit 18.

The output $V_1$ of the absolute value circuit is equal to the absolute value of $E_o$ ($V_1=|E_o|$), which is applied to a comparator circuit 19 where the output $V_1$ of the absolute value circuit $V_1$ is compared with a reference voltage predetermined. The output level of the comparator circuit 19 becomes "1" only when the input voltage $V_1$ is higher than the reference voltage, and it becomes "0" when the input voltage $V_1$ is lower than the reference voltage. The output of the comparator circuit 19 is applied to a switching circuit 20. When the output of the comparator circuit 19 is at the "0" level, the switching circuit 20 is rendered non-conductive (in "off" state), and upon operation of an oscillator circuit 21 a light emission diode 22 emits light. When the output of the comparator circuit 19 is at the "1" level, the switching circuit 20 is rendered conductive (in "on" state). Therefore, the oscillator circuit 21 is rendered inoperable, and accordingly the light emission diode emits no light.

Thus, when the mounting of the photoelectric detector assembly is suitable, the light emission diode 22 will emit light; however, if not, the light emission diode will not emit light.

The light emission diode 22 is further connected to the switching circuit 14 of FIG. 11, so that when the photoelectric detector section 10*b* or 10*a* (depending on the switching operation of the switch S in FIG. 13) detects the printed mark, the light emission diode 22 will emit light. Therefore, the light emission diode 22 can be also used as a monitor indicating whether or not the switch S has been suitably operated or whether or not the printed marks are detected.

I claim:

1. An apparatus including a photoelectric detector assembly for preventing incorrect collating signatures, said assembly having a first optical system and a second optical system each of which comprises:

(a) a common light source for said first and second optical systems;

(b) a condensor lens for converting light beams emitted from said light source into parallel light beams; and (c) optical means for introducing said parallel beams through a focusing lens to a surface of each signature and for introducing substantially all light beams reflected by said surface of each signature to a photoelectric element.

2. An apparatus as claimed in claim 1, in which said optical means of each of said first and second optical systems is a reflector having a through hole, said reflector being arranged in such a manner that said light beams reflected by said surface of each signature are introduced to said photoelectric element through said through hole.

3. An apparatus as claimed in claim 2, in which the area of said hole is substantially 10–50% of the area of said reflector irradiated by said parallel light beams.

4. An apparatus as claimed in claim 1, in which said optical means of each of said first and second optical systems is a transparent plate having a reflector portion on one surface thereof, said transparent plate being arranged in such a manner that said light beams reflected by said surface of each signature are focused on said reflector portion and are directed toward said photoelectric element by said reflector portion.

5. An apparatus as claimed in claim 4, in which the area of said reflector portion is substantially 10–50% of the area of said transparent plate irradiated by said parallel light beams.

* * * * *